US005528791A

United States Patent [19]

Wilson

[11] Patent Number: 5,528,791

[45] Date of Patent: Jun. 25, 1996

[54] WRINGER FLOOR MOP WITH PIVOTING HEAD

[75] Inventor: Frank G. Wilson, Malvern, Pa.

[73] Assignee: New Knight Inc., Paoli, Pa.

[21] Appl. No.: 493,882

[22] Filed: Jun. 23, 1995

[51] Int. Cl.[6] ..... A47L 13/144

[52] U.S. Cl. ..... 15/119.2; 15/244.1; 15/244.2

[58] Field of Search ..... 15/119.1, 119.2, 15/116.1, 116.2, 244.2, 144.1, 150, 229.6, 260, 262, 244.1, 228, 148

[56] References Cited

U.S. PATENT DOCUMENTS

| | | | |
|---|---|---|---|
| 2,740,146 | 4/1956 | Vaughn | 15/119 |
| 3,226,752 | 1/1966 | Antonucci, Jr. | 15/119 |
| 3,362,037 | 1/1968 | Griffin | 15/229 |
| 3,727,259 | 4/1973 | Wilson | 15/119.2 |
| 4,481,688 | 11/1984 | Graham | 15/119.2 |
| 4,516,287 | 5/1985 | Johnson et al. | 15/119.2 |
| 4,766,716 | 10/1988 | Huang | 401/139 |
| 4,850,075 | 7/1989 | Kresse et al. | 15/228 |
| 4,908,901 | 3/1990 | Torres | 15/119 |
| 5,097,561 | 3/1992 | Torres | 15/119.2 |
| 5,253,387 | 10/1993 | Kresse et al. | 15/228 |
| 5,272,783 | 12/1993 | Richardson et al. | 15/119 |
| 5,331,706 | 7/1994 | Graham | 15/119.2 |
| 5,455,978 | 10/1995 | Graham | 15/119.2 |

FOREIGN PATENT DOCUMENTS

| | | | |
|---|---|---|---|
| 1000046 | 10/1959 | France | 15/119.2 |

*Primary Examiner*—Gary K. Graham

*Attorney, Agent, or Firm*—Dann, Dorfman, Herrell & Skillman

[57] ABSTRACT

A wringer mop has a mop head housing, an elongated mop cartridge having an absorbent pad and a tubular mop handle. A pivot couples the mop head housing to the mop handle for pivotal movement therebetween. One or more pairs of spaced-apart wringer rollers are supported by the mop housing on either side of the mop cartridge to secure the mop cartridge within the mop head housing. An actuator mechanism includes a crank in the form of a linkage rod movably disposed within the tubular mop handle. A hooked end of the linkage rod extends within the mop housing into releasable pivotal engagement with the mop cartridge. The mop cartridge includes an tab having an opening therethrough which pivotally receives the hook. The actuator mechanism further includes a crank handle reversibly shiftable between first and second positions to pass the absorbent pad between the wringer rollers. The crank handle is reversibly shiftable into a third position to expel the mop cartridge from between the wringer rollers to permit removal of the mop cartridge.

4 Claims, 3 Drawing Sheets

WRINGER FLOOR MOP WITH PIVOTING HEAD

FIELD OF THE INVENTION

This invention relates generally to wringer mops, and, in particular, to wringer mops having a mop head replacement and actuator mechanism by means of which the mop head may be quickly and easily detached and replaced.

BACKGROUND OF THE INVENTION

Sponge wringer mops characterized by mop head replacement mechanisms are well-known in the prior art.

An example of this type of wringer floor mop is taught in U.S. Pat. No. 3,727,259, issued to Frank G. Wilson, on Apr. 17, 1973. Wilson taught a wringer mop head replacement and actuator mechanism which included a pair of spaced-apart parallel wringer rollers which were carried at the lower end of a mop head housing. An operating crank was provided by a linkage rod extended upward from the mop head cartridge through the mop housing and through a hollow handle to a pivotable crank handle. The operating crank/rod detachably connected at its lower end to the mop head cartridge within the mop head housing by means of a cooperating snap latch carried by the mop head cartridge.

The crank handle was shiftable between an upper position and a detented center position in order to shift the operating crank up and down and thereby wring out the mop head cartridge by passing it between the wringer rollers. The crank handle was also shiftable to a down position to expel the mop head cartridge and the lower end of the operating crank/rod from the mop head housing and from between the wringer rollers. When the crank handle was in the down position, the snap latch connection was completely exposed to permit easy cartridge replacement. The mop head snap latch device was mounted in an inverted channel member which retained a sponge or other absorbent element by compression of a marginal edge of the sponge of the cartridge between the channel member walls. The center of the channel base had an upstanding tunnel formation into which an operating crank lower end transverse arm was slidably received. The transverse arm was held in a mated position with the tunnel formation by a shiftable latch plate which was biased resiliently upward by the sponge material to capture the hook arm.

SUMMARY OF THE INVENTION

According to at least one aspect of the invention, a wringer mop comprises a mop head housing, an elongated mop cartridge having an absorbent pad and a tubular mop handle. A pivot couples said mop head housing to said mop handle so as to permit pivotal movement of said mop head housing with respect to said tubular mop handle. At least a pair of spaced-apart wringer rollers is supported by the mop head housing, one roller on either side of the mop cartridge. An actuator mechanism includes a linkage rod movably disposed within said tubular mop handle, one end of said rod extending within said mop head housing into releasable engagement with said cartridge so as to secure the mop cartridge against the mop head housing. A crank handle is reversibly shiftable between first and second positions to pass said absorbent pad between said wringer rollers.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE PREFERRED EMBODIMENT

Figure 1:
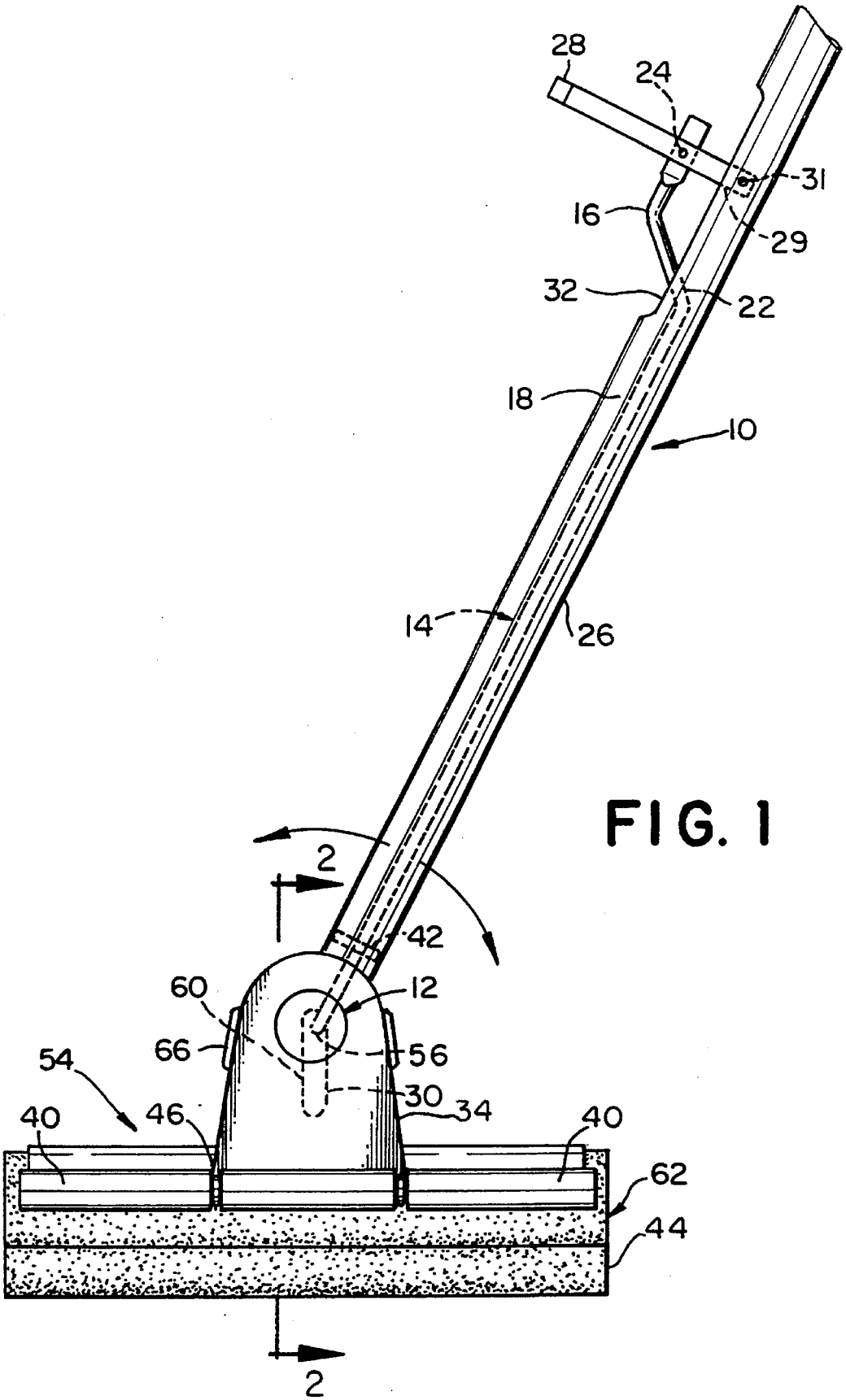
FIG. 1 shows a front elevational view of an operative lower portion of a wringer floor mop with pivoting head of the present invention.

Briefly, the present invention includes an improved wringer floor mop wherein the improvement is a pivot coupling the mop head and handle which permits cleaning access of the mop head cartridge to hard-to-reach locations while still permitting easy replacement of mop head cartridge and good structural integrity of the mop. The pivoting mop head has a mop head housing carrying the mop head cartridge wherein both the housing and the cartridge are pivotable with respect to a mop handle. The mop head housing is pivotally coupled to the mop handle and the mop head cartridge is pivotally coupled to an actuator mechanism extending through the mop handle. The actuator mechanism includes a crank handle which is reversibly shiftable between first and second positions to pass an absorbent pad between wringer rollers which are mounted on the mop head housing. The lower end of the actuator mechanism is formed as a hook which pivotally mates with an opening in an upwardly extending tab provided on the mop head cartridge. The pivotable mating hook in cooperation with the tab provide securement of the mop head cartridge to the mop, as well as the ability of the cartridge to freely rotate with respect to the mop handle carrying the actuator mechanism. The crank handle of the actuator mechanism is reversibly shiftable into a third position effective to extend the mop head cartridge out of the mop head housing to permit unlatching of the actuator mechanism hook from the cartridge tab.

Referring to the drawings, wherein like numerals are used to indicate like elements throughout the several figures, there is shown a preferred embodiment pivoting wringer floor mop 10 of the present invention. The pivoting 10 wringer floor mop 10 of the present invention includes a hollow tubular mop handle 26 secured at its lower end between two preferably identical housing halves 36 of a hollow, bell-shaped mop head housing 34. The halves are secured by clips 66 and are permitted to pivot with respect to the hollow tubular handle 26. The housing halves 36 are secured to the hollow tubular handle 26 to permit the mop head housing 34 to pivot with respect to the hollow tubular handle 26 by means of a pivot indicated generally at 12. The pivoting mop head housing 34 secures an elongated replaceable mop cartridge 62 with an absorbent pad 44 for cleaning difficult to access locations. The upper end of the hollow tubular handle 26 may be adapted to mate with a hollow or solid handle extension (not shown).

Figure 3:
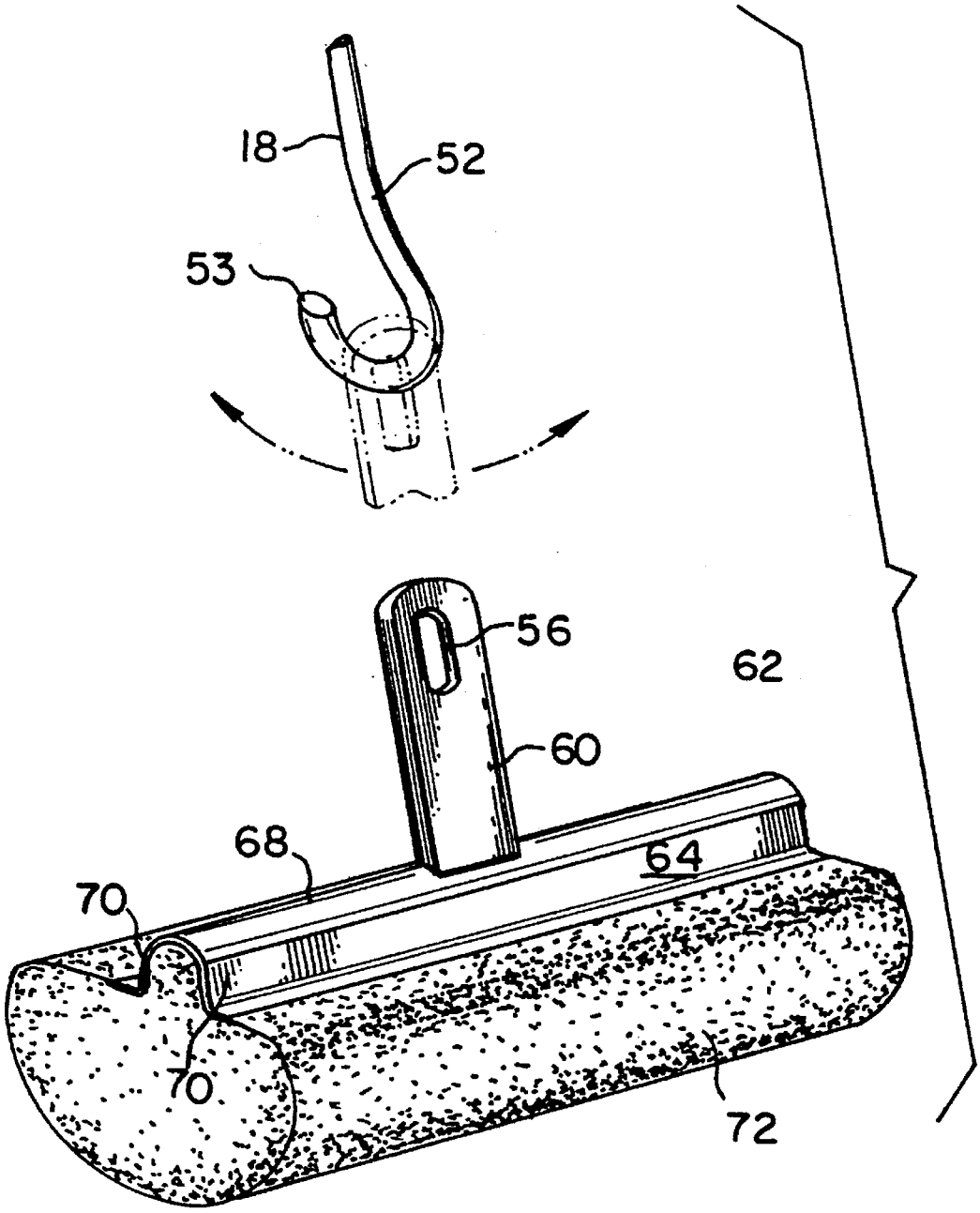
FIG. 3 shows a perspective view of the mop cartridge and a portion of the actuator mechanism of the wringer floor mop of FIG. 1.

The hollow tubular handle 26 is provided with an actuator including a crank preferably in the form of a linkage rod 14 formed from a single, bent steel rod or other suitable material. The linkage rod 14 has a long straight central linkage portion 18 and an upper short straight arm 16 laterally offset from the central linkage portion 18. The lower end of the central linkage portion 18 of the linkage rod 14 terminates in a hook 52, which extends into the mop head housing 34 into releasably pivotal engagement with an extending cartridge tab 60 portion of the replaceable mop cartridge 62 by passing through opening 56 of tab 60 and then away from the cartridge at the distal tip 53 of the lower end of the rod as shown in FIG. 3.

Figure 2:
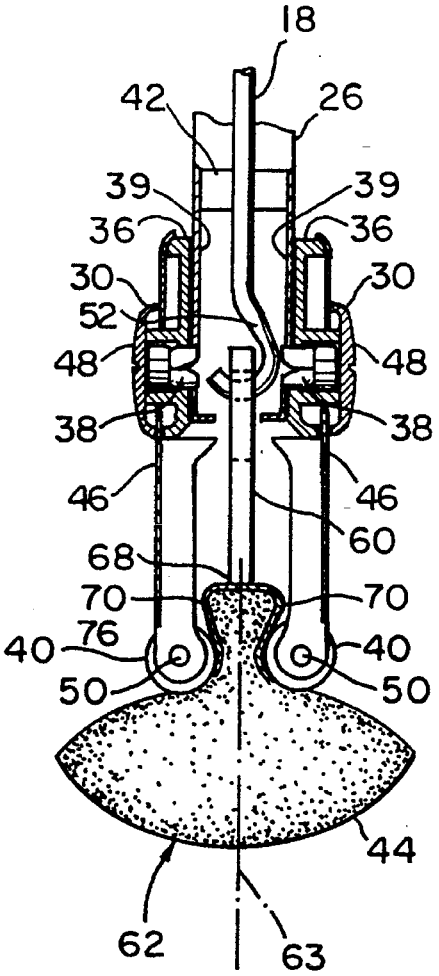
FIG. 2 shows a cross sectional view of the pivoting wringer floor mop taken along the lines 2—2 of FIG. 1.
Figure 4:
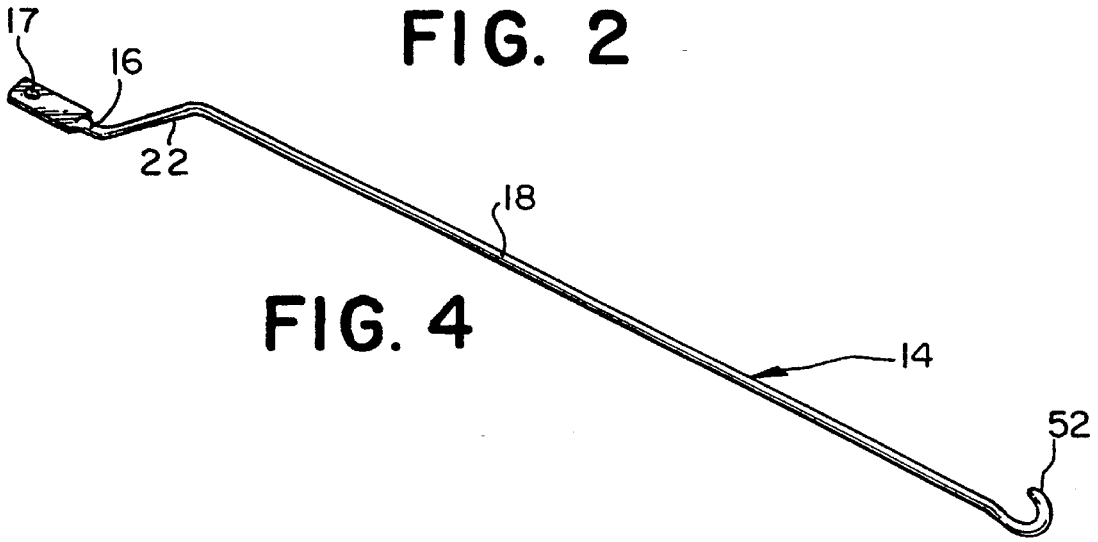
FIG. 4 is a side view of the linkage rod of the actuator mechanism of the pivotal wringer floor mop of FIG. 1.

Referring to FIG. 2, a longitudinal dimension of the mop cartridge 62 defines a pad plane, indicated by broken line 63, which plane extends into and out of FIG. 2. As can be seen in FIG. 2, the one end 52 of the linkage rod 14, which defines the hook engaged with the cartridge 62, lies in the plane of FIG. 2, which is a plane perpendicular to the pad plane represented by broken line 63. This promotes pivotal movement of the cartridge 62 on the hook end 52 of the rod in parallel with the pivotal movement of the mop head housing 34 on the end of hollow tubular handle 26.

The upper short straight arm 16 of the linkage rod 14 is provided with an opening 17 for pivotable coupling to a T-shaped crank handle 28 having a stem portion 29. A pivot is provided coupling the stem portion 29 and the linkage rod 14, for example, by a rivet 24. The upper short straight arm 16 of the linkage rod 14 is connected to the central linkage portion 18 by a diagonal connection portion 22. The diagonal connection portion 22 extends outwardly through an elongated slot 32 in a wall portion of the hollow tubular handle 26 proximate the upper end of the hollow tubular handle 26. The lower end of the stem 29 of the T-shaped crank handle 28 extends into the tubular interior of the hollow tubular handle 26 through the elongated slot 32 and is pivotally secured therein, for example, by means of a rivet 31. A guide disk 42 may be provided to be held captive within the lower end of the hollow tubular handle 26 and the straight central linkage portion 18 of the rod 14 is slidably secured and centered by the guide disk 42.

Referring to FIG. 2, a pair of pivot bearings 38 are supported by leaf spring members 39 at the lower end of the hollow tubular handle. The halves 36 of the mop head housing 34 are each provided with a bearing recess 48 which rotatably receives one of the pivot bearings 38 and retains the received pivot bearing 38 during pivotal movement of the mop head housing 34 with respect to the hollow tubular handle 26. Thus the pivot bearings 38 and the bearing recesses 48 act cooperatively to provide the pivot 12 coupling the mop head housing 34 to the hollow tubular handle 26 in order to facilitate the use of the pivoting wringer floor mop 10 when obtaining cleaning access to hard to reach locations. In the preferred embodiment of the pivoting wringer floor mop 10, the mop head housing 34 may pivot through an arc of up to about ninety degrees with respect to the hollow tubular handle 26 by means of the pivot bearings 38 and the bearing recesses 48. The ninety degree range is centered around the position wherein the longitudinal dimension of the replaceable mop cartridge 62 is perpendicular to the hollow tubular handle 26. The openings of the bearing recesses 48 may be covered with individual bearing caps 30.

Each pivoting housing half 36 of the mop head housing 34 is provided with depending ears 46 at its lower edges. Roller support shafts 50 axially rotatably extend through the depending ears 46. At least one and preferably at least three co-linear cylindrical wringer rollers 40 are rotatably mounted upon each of the roller support shafts 50. The halves 36 support the at least one and preferably at least three pairs of wringer rollers 40 on either side of the replaceable mop cartridge 62. The rollers 40, in turn, resiliently position or secure the proximal end of the replaceable mop cartridge 62 in the mop head housing 34 and provide a squeezing or wringing action for the purpose of extracting liquid retained in the absorbent pad 44 of the mop cartridge 62. The absorbent pad 44 may be formed of synthetic, open-celled foam rubber conventionally used for such pads or any other suitable material. The absorbent pad 44 is generally of a sector shape in cross-section because of the inward pinching action caused by the sidewalls 70 of the channel member 64, which operates upon a piece of foam rubber of generally square or rectangular cross-section.

The channel member 64 of the cartridge 62 has an upper wall 68 from which the channel sidewalls 70 downwardly convergingly extend. Each channel side wall 70 terminates in an outwardly turned lower marginal skirt 76 forming a detent recess in the region where the marginal skirt 76 and the side wall 70 join. The transverse distance between the detent recesses of the channel member 64 is substantially equal to or just slightly less than the distance between the facing pairs of wringer rollers 40. Thus the wringer rollers 40 may resiliently hold and secure the channel member 64 in a fixed position to mechanically stabilize the mop cartridge 62 when in use. It should be noted that the formation of the detent recesses by the configuration of the channel sidewalls 70 and marginal skirts 76, together with the spacing between the wringer rollers 40, normally prevents movement of the mop cartridge 62 in the up and down directions between the rollers 40 because of the outward flare of the channel member 64 at the upper edge and the outward flare of the skirts 76 at the lower edge.

FIGS. 1 and 2 illustrate the condition of the pivoting wringer floor mop 10 of the present invention with the replaceable mop cartridge 62 in its normal use position in which it is mechanically secured by the interaction between the wringer rollers 40 and the channel member 64. In the normal use condition, the crank handle 28 extends substantially straight out at a right angle from the hollow tubular handle 26 through the elongated slot 32. This position of the crank handle 28 is its center or neutral or "first" position.

When it is desired to squeeze or wring out the absorbent pad 44 of the replaceable mop cartridge 62, the crank handle 28 is pulled upward, to its up or "second" position away from the cartridge 62. Movement of the crank handle 28 to its up position causes the linkage rod 14 to move upward within the hollow tubular handle 20. Movement of the central linkage portion 18 of the linkage rod 14 pulls the mop cartridge 62 upward between the wringer rollers 40 and passes the absorbent pad 44 between the wringer rollers 40, which squeeze out the liquid retained within the absorbent pad 44.

When the crank handle 28 is first pulled upward, the wringer rollers 40 are caused to move laterally outward away from one another in order to override the lower marginal skirts 76 of the channel member 64. When the crank handle 28 continues its upward movement, the wringer rollers 40 resiliently move inward and press against the absorbent pad 44 as the absorbent pad 44 is drawn upward between the housing halves 36. The absorbent pad 44 is again squeezed or wrung out as the crank handle 28 is moved downward to its first or center position and the absorbent pad 44 again passes between the wringer rollers 40.

The center or "first" position and the up or "second" position of the crank handle 28 are the only positions which are used during normal operation of the pivoting wringer floor mop 10. However, when the absorbent pad 44 of the pivoting mop head 54 is worn or otherwise requires replacement, the crank handle 28 may be used to the extend the replaceable mop cartridge 62 from between the wringer rollers 40 for easy replacement. The extension of the mop cartridge 62 is accomplished by pressing the crank handle 28 in a downward direction to a down or "third" position within the elongated slot 32 through the wall of the hollow tubular handle 26. This pushes the central linkage portion 18 downward and the replaceable mop cartridge 62 downward through the wringer rollers 40, which are moved apart by the sloping surfaces of the channel sidewalls 70 of the mop cartridge 62. As should be clear, the crank handle 28 is reversibly shiftable into either the up or "second" position or the down or "third" position, as desired, from the center position.

The linkage rod 14 moves downward within the hollow tubular handle 26 until the pivoting hook 52 of the linkage rod 14 extends below the level of the wringer rollers 40. When the pivoting hook 52 is exposed in this manner, it may be disengaged from its releasable engagement with the pivot opening 56 of the cartridge tab 60 and the replaceable mop cartridge 62 may be released from the wringer floor mop 10. When a new replaceable mop cartridge 62 is secured to the pivoting hook 52, the crank handle 28 is pulled upward to the first or central position to withdraw the linkage rod 14 upward within the hollow tubular handle 26 until the wringer rollers 40 ride over the channel sidewalls 70 and again engage in the detenting recesses formed by the outwardly turned lower marginal skirts 76.

It will be appreciated by those skills in the art, that changes could be made to the embodiment described in the foregoing description without departing from the broad inventive concept thereof. It is understood, therefore, that this invention is not limited to the particular embodiment disclosed, but it is intended to cover all modifications which are in the scope and spirit of the invention as defined by the appended claims.

I claim:

1. A wringer mop, comprising in combination:

a mop head housing;

an elongated mop cartridge with an absorbent pad;

a tubular mop handle;

a pivot coupling said mop head housing to said mop handle so as to permit pivotal movement of said mop head housing with respect to said tubular mop handle;

at least a pair of spaced-apart wringer rollers rotatably supported by said mop head housing, one roller on either side of the said mop cartridge;

an actuator mechanism including an elongated linkage rod movably disposed within said tubular mop handle, one end of said linkage rod extending within said mop head housing and being releasably and pivotally engaged with said mop cartridge and another end of said linkage rod pivotally coupled with a crank handle which is pivoted to said tubular handle, said crank handle reversibly shiftable between first and second positions to pass said absorbent pad between said wringer rollers.

2. The wringer mop of claim 1, wherein said one end of said linkage rod comprises a hook extending through a portion of said cartridge and then away from said cartridge at a distal tip of said one end.

3. The wringer mop of claim 2, wherein said mop cartridge includes an extending tab having an opening therethrough pivotally receiving said hook.

4. The wringer mop of claim 1, wherein said crank handle is reversibly shiftable into a third position effective to expel said mop cartridge out of said mop housing and from between said wringer rollers for unlatching said mop cartridge from said linkage rod.

* * * * *